US007795811B2

(12) United States Patent
Maeshima et al.

(10) Patent No.: US 7,795,811 B2
(45) Date of Patent: Sep. 14, 2010

(54) PLASMA DISPLAY PANEL

(75) Inventors: Satoshi Maeshima, Hyogo (JP); Masashi Morita, Osaka (JP); Mitsuo Saitoh, Osaka (JP); Kouji Okazaki, Kyoto (JP); Yoshiyasu Honma, Osaka (JP)

(73) Assignee: Panasonic Corporation, Osaka (JP)

( * ) Notice: Subject to any disclaimer, the term of this patent is extended or adjusted under 35 U.S.C. 154(b) by 210 days.

(21) Appl. No.: 12/013,753

(22) Filed: Jan. 14, 2008

(65) Prior Publication Data

US 2009/0021164 A1 Jan. 22, 2009

(30) Foreign Application Priority Data

Jan. 15, 2007 (JP) ..... 2007-005601

(51) Int. Cl.
*H01J 17/49* (2006.01)

(52) U.S. Cl. ..... 313/587

(58) Field of Classification Search ..... 313/581–587
See application file for complete search history.

(56) References Cited

U.S. PATENT DOCUMENTS

2006/0152158 A1* 7/2006 Lee et al. ..... 313/586
2007/0001601 A1* 1/2007 Nishitani et al. ..... 313/582

FOREIGN PATENT DOCUMENTS

| | | |
|---|---|---|
| JP | 2000-63171 | 2/2000 |
| JP | 2002-33053 | 1/2002 |
| JP | 2003-317631 | 11/2003 |
| KR | 10-2004-0037270 | 5/2004 |

* cited by examiner

*Primary Examiner*—Joseph L Williams
*Assistant Examiner*—Brenitra M Lee
(74) *Attorney, Agent, or Firm*—Wenderoth, Lind & Ponack, L.L.P.

(57) ABSTRACT

A PDP having display electrodes formed on a front glass substrate, a dielectric layer, and a protective film is provided, where the protective film is a metal oxide film which includes magnesium oxide, and the product of the film thickness at any arbitrary point in the protective film and the ratio of the maximum luminescence intensity of light emission having a wavelength between 400 nm and 450 nm to the maximum luminescence intensity of light emission having a wavelength between 330 nm and 370 nm as measured in accordance with the cathode luminescence method at the arbitrary point has variation within a range of ±15% as the distribution within the surface of the protective film.

2 Claims, 5 Drawing Sheets

PLASMA DISPLAY PANEL

BACKGROUND OF THE INVENTION

The present invention relates to a plasma display panel having a protective film for reducing variation in a discharge delay time within a substrate surface.

In recent years, flat display panels, such as liquid crystal display panels (LCDs), field emission display panels (FEDs), and plasma display panels (hereinafter referred to as PDPs) have been drawing attention as display devices of which the size can be increased and the thickness reduced from among color display devices used for displaying images, such as computers and televisions. From among these, PDPs have particularly excellent characteristics in terms of high speed response, wide view angle, and the like, and have been actively developed in order to increase the definition and quality of images.

PDPs are basically formed of a front plate and a rear plate. The front plate is formed of a glass substrate, display electrodes formed of scanning electrodes made of transparent electrodes in stripe form and sustain electrodes made of bus electrodes formed on one main surface, as well as support electrodes, a dielectric layer which covers the display electrodes so as to function as a capacitor and forms a wall charge through discharge, and a protective film formed on the dielectric layer. Meanwhile, the rear plate is formed of a glass substrate, address electrodes in stripe form formed on one main surface in a direction crossing the display electrodes, a dielectric layer covering the address electrodes, partitions formed on the dielectric layer, and substance layers formed between the partitions, each of which emits red, green, or blue light.

The front plate and the rear plate are air-tight-sealed together so that the sides on which electrodes are formed face each other, and spaces between these are sealed air tight, and a discharge gas, such as Ne—Xe, is sealed in the discharge spaces where discharge cells are formed on the partitions under pressure of 400 Torr to 600 Torr. A video signal voltage is selectively applied to the display electrodes, and thus, a discharge gas is discharged, which then generates ultraviolet rays so that the substance layers of each color are excited and emit red, green, and blue light, and thus display a color image.

Metal oxide films, such as of magnesium oxide (MgO), having excellent resistance to sputtering and excellent secondary electron discharging properties are formed in a thin film process, for example an electron beam vapor deposition method, as a protective film formed on the dielectric layer of the front plate, and are widely used. The excellent resistance to sputtering of MgO allows the dielectric layer to be protected from ion impact (sputtering) resulting from discharge. In addition, secondary electrons are efficiently discharged into the discharge cells as a result of the excellent secondary electron discharging properties, and thus, the protective film has a function of lowering the voltage at which discharge starts.

In addition, it is known that the film quality and properties of MgO thin films used as protective films vary, due to differences resulting from oxygen deficiency and mixing in of impurities. In the process for forming a protective film, an oxygen ($O_2$) gas is supplied into, for example, an electron beam vapor deposition chamber, under a predetermined partial pressure, and thus, an amount for oxygen deficiency in the MgO thin film is adjusted so that the film is formed with target properties under control. There is easily an oxygen deficiency in films formed without supply of $O_2$ gas, because oxygen atoms easily come off from the film material when the metal oxide, for example MgO, which is the film material, vaporizes as a result of irradiation with an electron beam. Accordingly, it is necessary to supply an $O_2$ gas to the growing surface all of the time.

Demand for increase in the size of screens and definition has been increasing for PDPs, due to large screen size full high vision screens, and thus, it is more desired for the area of screens and the number of scanning lines to be increased, and at the same time, for the corresponding addressing period to be shortened. In order to shorten the addressing period, the protective film is required to have higher secondary electron discharging performance. That is to say, it is necessary to increase the number of scanning lines as the discharge cell structure becomes highly finer, and for the pulse width of address pulses applied during the addressing period to be narrower, so that drive can be carried out at higher speed. In terms of the discharge phenomenon, there is a discharge delay, such that actual discharge occurs considerably later than the rise in the applied pulse. Therefore, the probability of discharge being completed within the applied pulse width becomes low, causing failure in light-up, so that write-in cannot be carried out in cells which should be lit up, and thus, flickering can be observed on the screen display. In order to shorten this discharge delay time, higher secondary electron discharging performance is required for the protective film.

Examples have been disclosed, where the index of refraction of a protective film is adjusted to 1.4 to 2.0 for light having a wavelength of 400 nm to 1000 nm, and thus, the discharge delay time shortens and the resistance to sputtering increases, so that excellent display quality can be maintained (see for example Japanese Unexamined Patent Publication No. 2003-317631).

In addition, methods have been disclosed, according to which a hydrogen plasma process is carried out on a protective film that is formed by introducing an $O_2$ gas, and thus, the volume resistivity of the protective film is adjusted to $3.5\times10^{11}$ Ω·cm or higher, or three or more hydrogen atoms are contained per 100 atoms in the entirety of the protective film at that time, and thus, shortening of the discharge delay time and lowering of the discharge voltage can be achieved (see for example Japanese Unexamined Patent Publication No. 2002-33053).

It is known that the discharge delay time varies depending on the film thickness of the MgO thin film. This is considered to be because the degree of crystal growth in the MgO thin film is different depending on the film thickness, which causes a difference in the secondary electron discharging properties. Accordingly, the distribution in the film thickness of the protective film affects the distribution in the discharge delay time within the substrate surface. On high definition screens of conventional PDP where the resolution is 1366×768, images can be displayed without such defects as failure of light-up occurring in the case where the distribution of the discharge delay time within the substrate surface is within ±50%. On full high definition screens where the resolution of the PDP is 1920×1080, however, there are issues causing defects in image display unless the distribution in the discharge delay time within the substrate surface is further reduced.

Accordingly, further reduction in the discharge delay time and uniformity on the surface has been required for higher definition PDPs having higher image quality in recent years. In the case where a protective film according to the technology in the above described Japanese Unexamined Patent Publication No. 2003-317631 or Japanese Unexamined Patent Publication No. 2002-33053 is used, an unstable PDP in which the distribution in the discharge delay time within the substrate surface is in a range of ±40% or greater resulting in non-uniformity. Therefore, there is an issue, such that there are discharge cells which do not have sufficient discharge properties on the surface, causing defects in light-up or flickering on the display, including failure in light-up or errors in discharge during initialization.

The present invention is provided in order to solve the above described issues, and an object thereof is to provide PDP (plasma display panel) having a protective film for reducing variation in a discharge delay time within a substrate surface.

SUMMARY OF THE INVENTION

In accomplishing these and other aspects, according to a first aspect of the present invention, there is provided a plasma display panel having display electrodes formed on a substrate, a dielectric layer, and a protective film, wherein the protective film is a metal oxide film which includes magnesium oxide, and which is a film that a product of a film thickness at any arbitrary point in the protective film and a ratio of a maximum luminescence intensity of light emission having a wavelength between 400 nm and 450 nm to a maximum luminescence intensity of light emission having a wavelength between 330 nm and 370 nm as measured in accordance with a cathode luminescence method at the arbitrary point has variation within a range of ±15% as a distribution within a surface of the protective film.

By providing this configuration, PDPs where variation in the discharge delay time within the substrate surface is reduced so that high quality images can be displayed on a high definition display having full high definition can be gained.

Furthermore, the protective film may be a film of which the ratio of the maximum light intensity for light having a wavelength between 400 nm and 450 nm as measured in accordance with a cathode luminescence method, to the maximum light intensity for the light having a wavelength between 330 nm and 370 nm may be 1.08 or greater. Furthermore, it is desirable that the protective film may be a film of which the average film thickness of the protective film may be in a range of from 700 nm to 900 nm, and the distribution within the surface may be ±10% or lower.

By providing this configuration, variation in the discharge delay time within the substrate surface can further be reduced, and PDPs having a large screen and still making high definition, high quality image display possible can be gained.

According to the present invention, PDP's where variation in the discharge delay time within the substrate surface is reduced so that even large screens can provide high definition, high quality image display can be provided.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
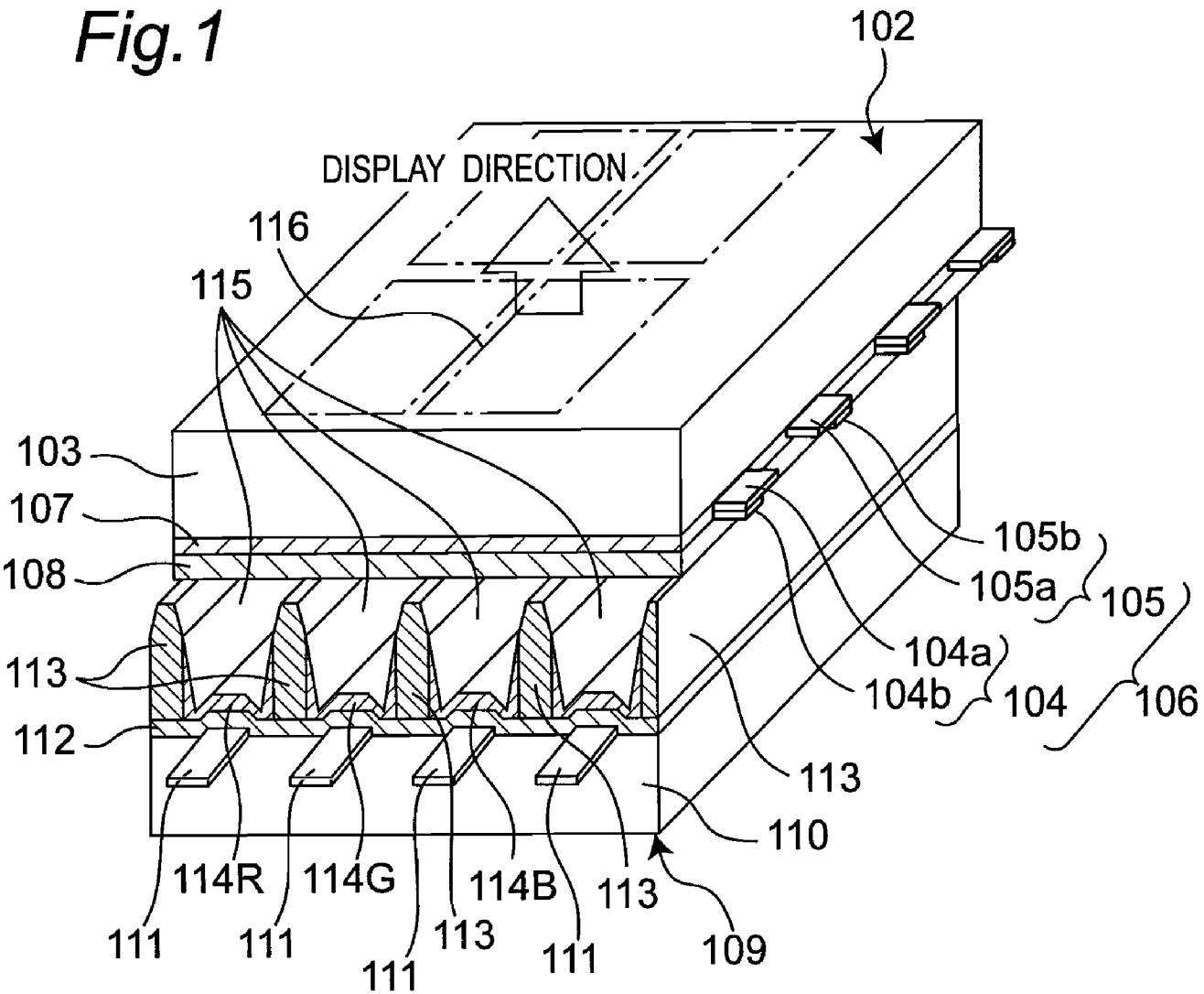
FIG. 1 is a perspective view showing the configuration of a PDP according to an embodiment of the present invention.

Before the description of the present invention proceeds, it is to be noted that like parts are designated by like reference numerals throughout the accompanying drawings.

In the following, the embodiments of the present invention are described in detail in reference to the drawings.

Embodiments

FIG. 1 is a perspective view showing the configuration of the PDP (plasma display panel) according to an embodiment of the present invention.

As shown in FIG. 1, a PDP has the structure of an AC type PDP, which is a surface discharge type having a front plate 102 and a rear plate 109 which face each other. Pairs of a scanning electrode 104 for inputting a scanning signal for sequential display and a sustain electrode 105 for inputting a sustain signal for discharge are formed in parallel to each other on the main surface of a front glass substrate 103 of the front plate 102 so that a plurality of display electrodes 106 in line form which become row electrodes are formed by the scanning electrodes 104 and the sustain electrodes 105. The scanning electrodes 104 and the sustain electrodes 105 are formed of transparent electrodes 104*a* and 105*a* and bus electrodes 104*b* and 105*b* formed respectively on the transparent electrodes 104*a* and 105*a*.

On the main surface of the front glass substrate 103, a dielectric layer 107 for covering the display electrodes 106 and forming a wall charge through discharge is formed. Furthermore, a dielectric protective film (hereinafter referred to as protective film) 108 made of a metal oxide which protects the dielectric layer 107 from ion impact as a result of discharge and becomes a secondary electron emitting-thin film is formed on the dielectric layer 107 so as to cover the dielectric layer 107. In addition, a light blocking layer (not shown) for enhancing the contrast on the display surface may be sometimes formed between adjacent pairs of electrodes of the scanning electrodes 104 and sustain electrodes 105.

A plurality of address electrodes 111 which become column electrodes for inputting a display data signal are formed on the main surface of a rear glass substrate 110 of the rear plate 109 in a direction crossing the display electrodes 106 on the front plate 102. On the main surface of the rear glass substrate 110, a base dielectric layer 112 is formed over the address electrodes 111. Furthermore, partitions 113 are formed on the base dielectric layer 112, parallel to the address electrodes 111, and substance layers 114R, 114G, and 114B which respectively emit red, green, and blue light are provided between the partitions 113.

The front plate 102 and the rear plate 109 are placed in such a manner that the sides on which the electrodes are formed face each other and the peripheral portions are sealed with a sealing material, such as frit glass. After that, a degassing process is carried out on a PDP unit formed by sealing the peripheral portion of the front plate 102 and the peripheral portion of the rear plate 109 with the sealing material while the PDP unit is heated, and after that, a rare gas, such as He, Ne, or Xe, is sealed in spaces of the PDP unit under pressure of, for example, 400 Torr to 600 Torr, as a discharge gas. Furthermore, an aging process is carried out, so that an aging is carried out where a drive pulse having a predetermined voltage and waveform is applied to the respective electrodes, for discharging, and thus, a display panel of a PDP where a plurality of discharge cells 116 having discharge spaces 115 are formed is completed.

A circuit board on which a driver IC for driving the display for supplying electrical signals to the display electrodes 106 respectively made up of the scanning electrodes 104 and the sustain electrodes 105, as well as address electrodes 111, is mounted is connected to the completed PDP. The PDP connected to the circuit board is built into a housing together with a control signal circuit and a power supply circuit, and thus, a display apparatus is completed.

The PDP of the display apparatus is driven in the following manner. Addressing discharge is carried out in sequence between the respective electrodes on the front plate 102 and the rear plate 109, and a voltage pulse of a predetermined signal is applied to each electrode, so that the surface of the protective film 108 of a discharge cell 116 which is desired to light up is charged, and sustain discharge is carried out between adjacent display electrodes 106 on the front plate 102 in the discharge cell that is charged. As a result, the rare gas sealed in the discharge cell 115 is discharged, so that ultraviolet rays which are radiated through discharge excite substance layers of each color 114R, 114G, and 114B provided between partitions 113, and thus, emission of ultraviolet rays is converted to emission of visible light, red, green, and blue, and then, information made up of color images is displayed.

Figure 5:
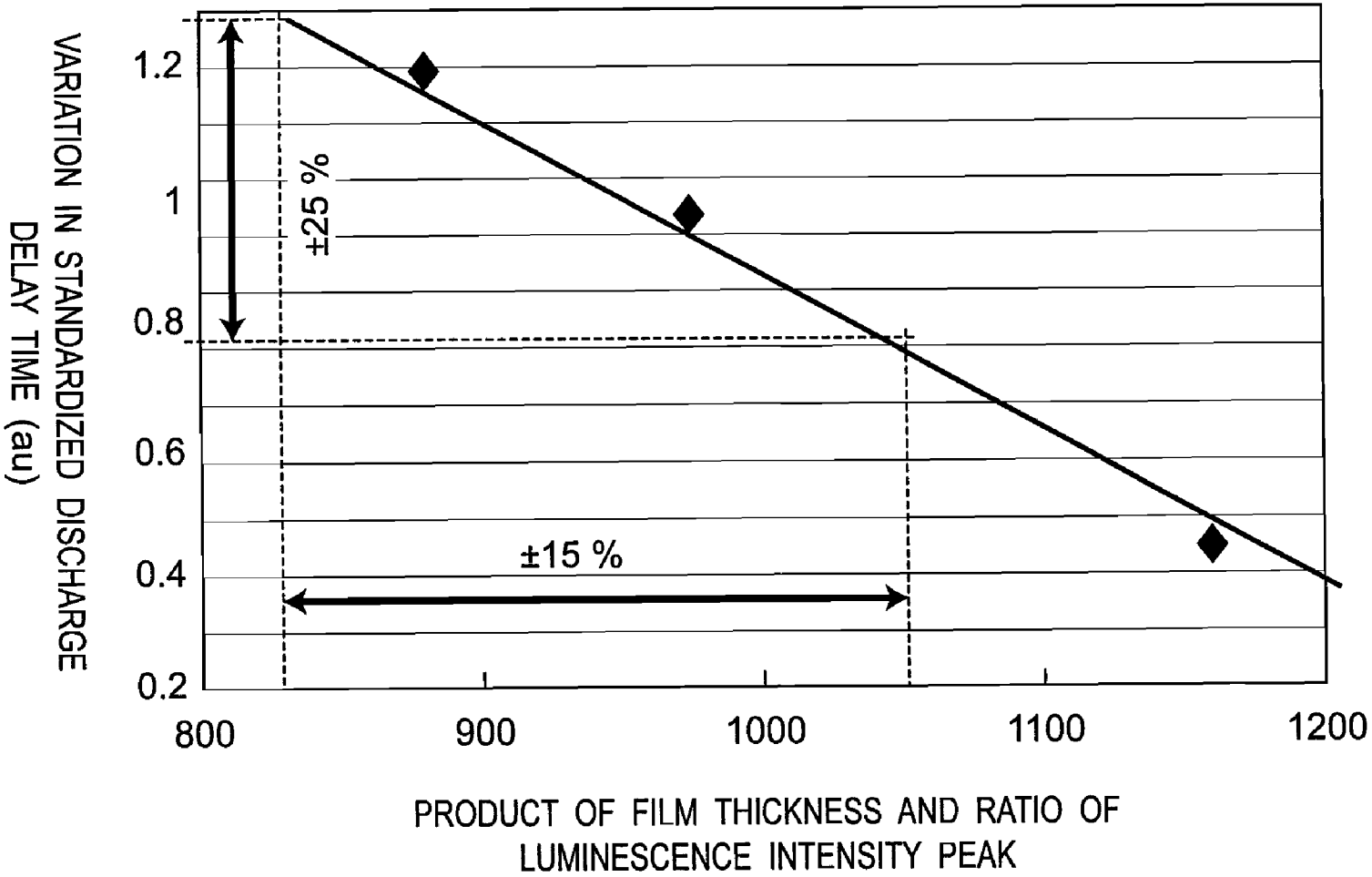
FIG. 5 is a graph showing the relationship between the product of the film thickness of the protective film and the ratio of the maximum light intensity, and the standardized discharge delay time of the PDP according to the embodiment.

The protective film 108 according to the embodiment of the present invention is formed of a metal oxide film including MgO (magnesium oxide) formed so that the product of the film thickness at any arbitrary point on the protective film 108 and the ratio of the maximum luminescence intensity for light having a wavelength in a range of from 400 nm to 450 nm to the maximum luminescence intensity for light having a wavelength in a range of from 330 nm to 370 nm in accordance with a cathode luminescence method at the arbitrary point has variation within a range of ±15% of the average value of the products between a plurality of points within the plane. Here, the reason why the variation falls within a range of ±15% is that in order to display high quality images without display flickering on a large screen with high definition, it is required that the variation in the discharge delay time is restricted to ±25% or less within the surface. Therefore, as shown in FIG. 5 described later, it is required for the product to fall within ±15% of the average value of the products of the film thicknesses and the ratios of the maximum luminescence intensities.

The cathode luminescence method is a technique for analysis according to which light emission is detected as the energy relaxation process when a sample is irradiated with an electron beam so that information, for example information on defects in the sample, is gained. According to the embodiment of the present invention, arbitrary points on the protective film 108 are directly irradiated with an electron beam, and then, the cathode luminescence, which is the light emission resulting from excitation, is detected. Thus, the PDP is formed by using the front plate 102 having the protective film 108 where the range of variation in the value of the product of the film thickness of the protective film 108 and the ratio of the maximum luminescence intensity for light having a wavelength in the above described range, which is gained in accordance with the cathode luminescence method, is prescribed so as to set to be within the range of ±15%.

In this manner, the product of the film thickness at any arbitrary point on the protective film 108 and the ratio of the maximum luminescence intensity is prescribed so as to set to be within the predetermined range in terms of the distribution within the substrate surface, and thus, at a plurality of points within the surface of the front glass substrate 103, the distribution in the discharge delay time within the substrate surface is restricted to ±25% of the average value or lower. As a result, the variation in the discharge delay time within the substrate surface is reduced, so that high quality images without display flickering can be displayed on a large screen with high definition.

Here, it is desirable and preferable for the above ratio of the maximum luminescence intensity for light having a wavelength between 400 nm and 450 nm to the maximum luminescence intensity for light having a wavelength between 330 nm and 370 nm to be 1.08 or greater. Here, the range of from 330 nm to 370 nm and the range of from 400 nm to 450 nm are electron energy levels generated at a time when defects originating from $H_2O$ are caused in MgO film structure as one example of the protective film 108, respectively. The discharge properties (here, variation in discharge delay time) of the PDP can be improved by electrons emitted from the electron energy levels having such ranges. According to the cathode luminescence method, light emission is divided into plural light beams by a spectroscope. As a result, peaks are extracted from the obtained light emission wavelength profile by using a Gauss distribution to obtain the intensities of the wavelength ranges.

The reason why the ratio of the maximum luminescence intensities is 1.08 or higher is described below. That is, according to the relation between the amount of $H_2O$ ($H_2O$ partial pressure) in the process of FIG. 4 described later and the ratio ($A_2/A_1$), if the amount of $H_2O$ ($H_2O$ partial pressure) in the process becomes smaller, the ratio ($A_2/A_1$) may be deteriorated. In other words, this ratio ($A_2/A_1$) is correlated with the state density of the electron energy levels generated due to defects originating from $H_2O$ in the MgO film structure as described above, that is, the amount of emitted electrons. Therefore, in the PDP with the MgO film structure having defects originating from $H_2O$ and having the ratio of the maximum luminescence intensities of less than 1.08, the variation in the discharge delay time becomes increased, resulting in causing discharge errors in write-in time and thus causing display flickering. In order to prevent such defects, it is required that the ratio of the maximum luminescence intensities is 1.08 or higher. Furthermore, it is desirable for the average value of the film thickness of the protective film 108 to be in a range of from 700 nm to 900 nm, and it is preferable for the distribution of the change in the film thickness within the surface of the protective film 108 to be ±10% or smaller. As a result, the variation in the discharge delay time within the surface of the substrate can be further reduced, and higher quality PDPs can be implemented. Here, the reason why the average value of the film thicknesses of the protective film 108 is in the range of from 700 nm to 900 nm is described below. That is, when the average value of the film thicknesses of the protective film 108 is less than 700 nm, the life of the PDP becomes shortened. This is because the MgO film serving as one example of the protective film 108 due to the lighting-up is continued to be subjected to sputtering, and then when the protective film 108 is vanished, discharge can not be performed. In order to ensure the life of 100,000 hours as the PDP, it is required that the average value of the film thicknesses of the protective film 108 is 700 nm or higher. On the other hand, when the average value of the film thicknesses of the protective film 108 is more than 900 nm, the voltage becomes increased due to lack of electric charge, resulting in causing poor lighting-up. When the thickness of the protective film 108 becomes larger, the degree of crystal growth in the MgO is progressed, so that the film has a film structure for easily emitting electrons. That is, it is difficult to keep wall charge accumulated through initialization, and then difference in electrical potential is lost, resulting in no discharge at set voltage.

Figure 2:
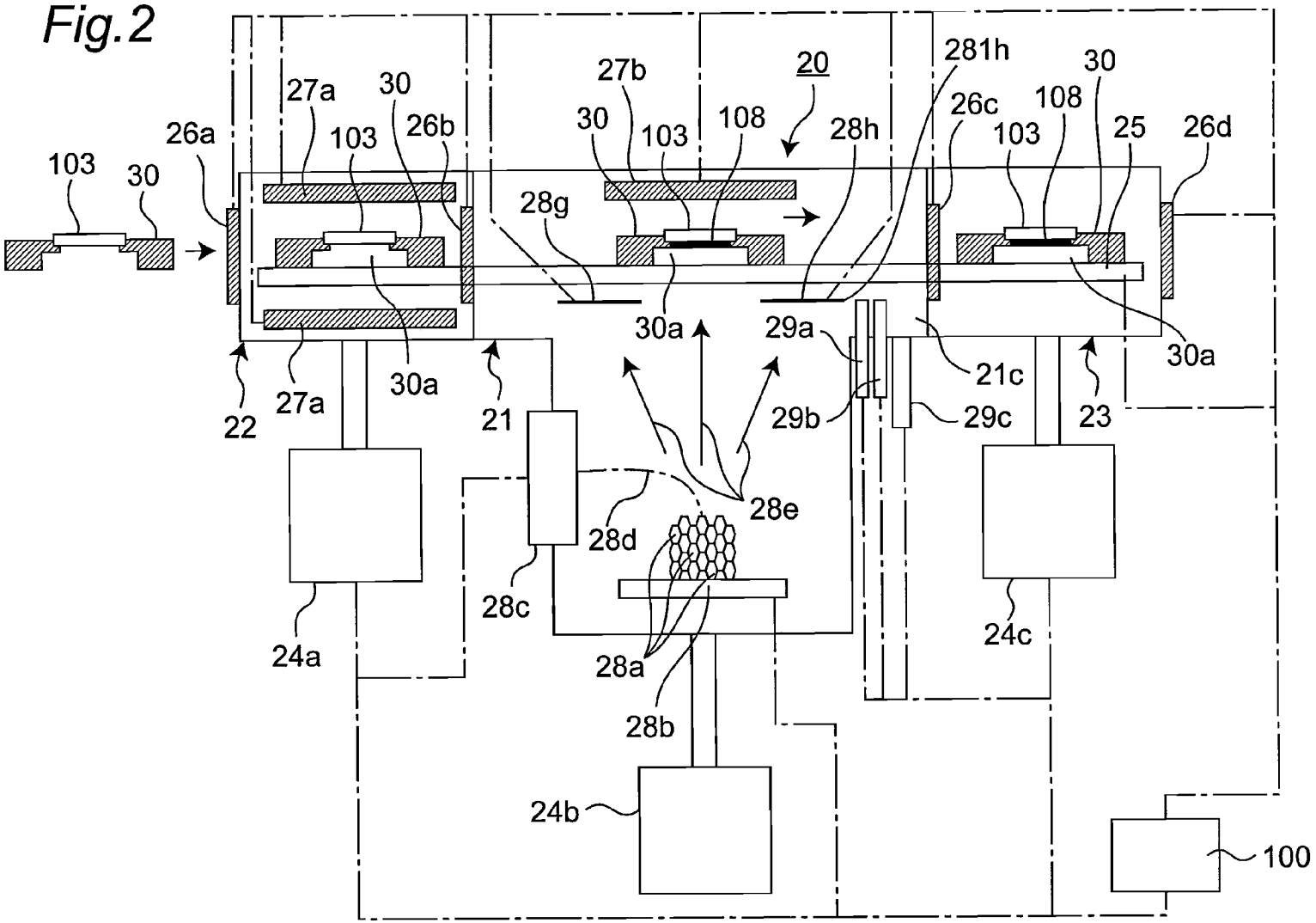
FIG. 2 is a view showing a film forming apparatus used in one step in the manufacturing method for the PDP according to the embodiment in FIG. 1.

The reason why the distribution of the change in the film thickness within the surface of the protective film 108 to be ±10% or smaller is described below. That is, if the distribution of the change in the film thickness within the surface of the protective film 108 is more than ±10%, in a case where the center of the film thickness as a target value is 800 nm in terms of ensuring resistance to sputtering, firstly, there is some possibility of having the film thickness of 720 nm at the thinnest portion of the protective film. As a result, in consideration of variation of film thicknesses of respective products in mass production lots of PDPs, it is difficult to ensure the life of the PDP. In addition, there is some possibility of having the film thickness of 880 nm at the thickest portion of the protective film, resulting in difficulty of keeping wall electric charge. Next, the manufacturing method for the PDP according to the embodiment of the present invention is described in detail in reference to FIG. 2. FIG. 2 is a view showing the film forming apparatus used in one step of the manufacturing method for the PDP according to the embodiment of the present invention.

First, a plurality of pairs of scanning electrodes 104 and sustain electrodes 105 in stripe form are formed on a front glass substrate 103 in order to gain the front plate 102 shown in FIG. 1. Specifically, a transparent conductive film, such as of ITO, is formed on the front glass substrate 103 through a film forming process using a vapor deposition method or a sputtering method, and after that, the formed transparent conductive film is patterned using a photolithographic method or the like, so that transparent electrodes 104*a* and 105*a* are formed. Furthermore, a film of, for example, Ag, is formed and layered on top of the transparent electrodes 104*a* and 105*a* through a film forming process using a printing method or the like. Then, the film of Ag is patterned using a photolithographic method or the like, so that the bus electrodes 104*b* and 105*b* are formed. In this manner, display electrodes 106 made up of the scanning electrodes 104 and the sustain electrodes 5 are gained.

Next, the dielectric layer 107 is formed so as to cover the display electrodes 106 formed in accordance with the above described method. The dielectric layer 107 is formed by heating and sintering a paste including a lead based or non-lead based glass material after the paste is applied on the display electrode 106 and the main surface of the front glass substrate 103 in accordance with, for example, a screen printing method. As the paste including a lead based glass material, a mixture of, for example, PbO (70 wt %)-$B_2O_3$ (15 wt %)-$SiO_2$ (10 wt %)-$Al_2O_3$ (5 wt %) and an organic binder (binder material where 10% of ethyl cellulose is melted into α-terpineol can be cited as an example) is used. Subsequently, the dielectric layer 107 formed so as to cover the display electrodes 106 in this manner is coated with the protective film 108 of a metal oxide film including, for example, MgO, and thus, the front plate 102 is formed. The process for forming the protective film 108 is described in detail below, together with a film forming unit used.

Meanwhile, a plurality of address electrodes 111 in stripe form are first formed on the rear glass substrate 110, in order to gain the rear plate 109 shown in FIG. 1. Specifically, a conductive material film, such as of Ag, is formed on one surface of the rear glass substrate 110 in accordance with a film forming process using a printing method or the like. After that, the formed conductive material film is patterned in accordance with a photolithographic method or the like, and thus, the address electrodes 111 are formed. These address electrodes 111 are coated with the base dielectric layer 112, and furthermore, the partitions 113 are formed and placed parallel to each other between the address electrodes 111 on the base dielectric layer 112. Then, a substance ink in paste form made of red (R) substance particles and an organic binder, a substance ink in paste form made of green (G) substance particles and an organic binder, or a substance ink in paste form made of blue (B) substance particles and an organic binder are applied in the respective groove portions between the respective partitions 113, and sintered so that the organic binders are burned away so that the substance particles are bound to the partitions 113 and the like and thus, substance layers 114R, 114G, and 114B are formed, and thus, the rear plate 109 is formed.

The front plate 102 and the rear plate 109 fabricated in accordance with the above described methods are layered on top of each other in such a manner that the display electrodes 106 on the front plate 102 and the address electrodes 111 on the rear plate 109 are superposed on each other so as to become perpendicular to each other, and a sealing member including glass having a low melt point is inserted between the peripheral portions and sintered so as to be converted to an airtight sealing layer (not shown), so that the peripheral portions are sealed. Thus, the PDP unit is formed in which the peripheral portion of the front plate 102 and the peripheral portion of the rear plate 109 are sealed with the sealing member. Then, air is once discharged from inside the discharge spaces 115 of the PDP unit to a high level vacuum, and after that, a discharge gas (for example an He—Xe based or Ne—Xe based mixed rare gas) is sealed in under predetermined pressure, and thus, the display panel of the PDP 1 is completed.

Next, the step of forming a protective film 108 of a metal oxide film, such as of MgO, is described in reference to the film forming apparatus 20 in FIG. 2. In the embodiment of the present invention, the protective film 108 is formed using the film forming apparatus 20 in accordance with an electron beam vapor deposition method according to which the rate of film formation is high and a relatively high quality metal oxide film can be formed. As the method for forming the protective film 108 of MgO, which is a metal oxide film, a sputtering method, an ion plating method, or the like can be used, in addition to the electron beam vapor deposition method described below.

As shown in FIG. 2, the film forming apparatus 20 is provided with: a vapor deposition chamber 21 which becomes a film forming chamber where the protective film 108 of an MgO thin film is formed on a front glass substrate 103; a substrate carry-in chamber 22 into which substrates are carried in where the front glass substrate 103 is heated in advance, before the front glass substrate 103 is put in the vapor deposition chamber 21 and the gas is discharged in advance; and a substrate carry-out chamber 23 from which substrates are carried out, where the front glass substrate 103 which is taken out from the vapor deposition chamber 21 is cooled after the completion of vapor deposition in the vapor deposition chamber 21. Each of the above described substrate carry-in chamber 22, vapor deposition chamber 21, and substrate carry-out chamber 23 has an airtight structure so that the inside can be made a vacuum, and the chambers 21, 22, 23 are independently provided with evacuating systems (evacuating device) 24*a*, 24*b*, and 24*c*. A conveying means (conveying device) 25 made up of conveying rollers, wires, chains, or the like is provided throughout the substrate carry-in chamber 22, the vapor deposition chamber 21, and the substrate carry-out chamber 23. In addition, partitions (blocking walls) 26*a*, 26*b*, 26*c*, and 26*d* which can be opened and closed partition the substrate carry-in chamber 22 from the external air, the substrate carry-in chamber 22 from the vapor deposition chamber 21, the vapor deposition chamber 21 from the substrate carry-out chamber 23, as well as the substrate carry-out chamber 23 from the external air, respectively. The drive of the conveying means 25 and the opening and closing of the partitions 26*a*, 26*b*, 26*c*, and 26*d* interlock, so that the degree of vacuum in the substrate carry-in chamber 22, the vapor deposition chamber 21, and the substrate carry-out chamber 23 can be adjusted so that the fluctuation in the degree of vacuum is minimal.

A front glass substrate 103 is led into the substrate carry-in chamber 22 of the film forming apparatus 20 from outside, and passes through the vapor deposition chamber 21 and the substrate carry-out chamber 23 in sequence through the partitions 26*a*, 26*b*, 26*c*, 26*d*. A predetermined process is carried out in each chamber, and after that, it is possible to carry the front glass substrate 103 out from the film forming apparatus 20 to the outside, and a sheet-feeding process for forming MgO thin films in sequence to form the protective films 108 can be carried out on a plurality of front glass substrates 103. Substrate heating means (substrate heating devices) 27*a* and 27*b*, using a heater such as an infrared ray lamp, for heating the front glass substrate 103 are placed at upper and lower portions or upper portion in the substrate carry-in chamber 22 and the vapor deposition chamber 21, respectively. Here, the front glass substrate 103 is usually conveyed in such a state as to be held by a substrate holding jig (carrier) 30, referred to as a tray.

Next, the vapor deposition chamber 21, which is a film forming chamber, is described. The vapor deposition chamber 21 is constructed by an airtight container to which the evacuating system (evacuating device) 24*b* is connected. Such vapor deposition chamber 21 is provided with a hearth 28*b* in which MgO particles are put, an electron gun 28*c*, a bias magnet (not shown) for applying a magnetic field, and the like. The electron beam 28*d* emitted from the electron gun 28*c* is biased by the magnetic field generated by the bias magnet so that MgO particles, which are the vapor deposition source 28*a*, are irradiated with the biased electron beam 28*d*, and calorie is injected into the vapor deposition source 28*a* (MgO particles) and the vapor deposition source 28*a* is heated and vaporized, and a steam flow 28*e* is generated from MgO, which is the vapor deposition source 28*a*. At this time, the front glass substrate 103 is placed on the substrate holding jig 30 for supporting the substrate having an opening 30*a* on its lower surface, and is moved from the left side to the right side in the direction of the arrow in FIG. 2 by the conveying means 25. At this time, an upstream-side shutter 28*g* and a downstream-side shutter 28*h* for blocking the stream flow 28*e* between the conveying means 25 and the hearth 28*b* are open, so that the lower side of the substrate holding jig 30 is kept in an open state. The MgO vaporized from the vapor deposition source 28*a* on the hearth 28*b* passes through the opening 30*a* in the substrate holding jig 30 as the steam flow 28*e*. MgO is deposited and adhered to a portion of the surface of the front glass substrate 103, where the portion is exposed through the opening 30*a* of the substrate holding jig 30, which is heated to a predetermined temperature by the substrate heating means 27*b* using a heater, for example an infrared ray lamp. As a result, protective films 108 which are MgO thin films in a desired form and with desired film thickness are formed on the surface of the front glass plate 103 in sequence. Here, "upstream side" means the side from which substrates 103 are carried in, in the conveying path along the substrate conveying direction, and "downstream side" means the side from which substrates 103 are carried out in the conveying path.

In addition, as shown in FIG. 2, in the film forming apparatus 20, a plurality of gas introducing means (gas introducing devices) 29*a* and 29*b* and as partial pressure detecting means (pressure detector) 29*c*, for example, a quadrupole mass spectrometer, are placed in the vicinity of the periphery of the partition 26*c* on the side of the substrate carry-out chamber 23 in the direction perpendicular to the direction in which the substrates are conveyed, in order to control the atmosphere within the vapor deposition chamber 21, particularly around the time when film formation is completed. In addition, in the vapor deposition chamber 21, which becomes a film forming chamber, $O_2$ gas, for example, is introduced into the vapor deposition chamber 21 by using one gas introducing means (gas introducing device) 29*a* and a gas including, for example, $H_2O$ (water) is introduced into the vapor deposition chamber 21 by using another gas introducing means (gas introducing device) 29*b*.

Thus, in order that the atmosphere within the vapor deposition chamber 21, particularly around the time when film formation is completed, is controlled during the film forming process for the protective film 108, the state of the gas is controlled as follows so as to be appropriate. In the embodiment of the present invention, the partial pressure of the gas, particularly around the time when film formation of the protective film 108 is completed in the vapor deposition chamber 21, is used as a parameter for controlling the state of the gas so that the state of the gas is appropriate within the vapor deposition chamber 21, which becomes a film forming chamber, and this partial pressure is kept within a constant range in the field where a film is formed, and thus, the protective film 108 is formed. As a result, a high quality protective film 108 of MgO thin film, which is a metal oxide film, can be stably formed. That is, in the film forming apparatus of the embodiment shown in FIG. 2, the gas including $H_2O$ is introduced into the vapor deposition chamber 21 by using the gas introducing means (gas introducing device) 29*b* located on the substrate carry-out chamber 23-side. Then, the protective film is affected by $H_2O$ only during a period from the time when a film with half of the predetermined film thickness is formed to the time when film formation is completed (a range of from a position on the left side of the shutter 28*h* to a position of the gate 26*c* in FIG. 2) (more specifically, a range of from a position where the front glass substrate 103 reaches in the vicinity of the center of the vapor deposition chamber 21 of the film forming apparatus of FIG. 2 to a position where the front glass substrate 103 reaches the gate 26*c* because film formation is carried out while the front glass substrate 103, that is an object, carried into the vapor deposition chamber 21 is conveyed at the constant speed by the conveying means (conveying device) 25). The control is carried out by controlling, as shown in FIG. 2, the amount of $H_2O$ introduced through the gas introducing means (gas introducing device) 29*b* in order that the amount of $H_2O$ detected by the partial pressure detecting means (partial pressure detector) 29*c* located on the substrate carry-out chamber 23-side falls within the predetermined range. In addition, in a case where $H_2O$ can be introduced and the amount of introduced $H_2O$ can be detected in the whole area of the vapor deposition chamber 21 by such a construction that the partial pressure detecting means (partial pressure detector) 29*c* and the gas introducing means (gas introducing device) 29*b* are also located on the substrate carry-in chamber 22-side, the amount of $H_2O$ may be controlled so as to keep the amount of $H_2O$ within a constant range in the vapor deposition chamber 21, during the whole processing period of time in the vapor deposition chamber 21.

Here, "field where a film is formed" indicates a space between the hearth 28*b* and the front glass substrate 103 within the vapor deposition chamber 21, and "partial pressure" indicates the partial pressure around the time when film formation of the protective film 108 is completed in the field where a film is formed in the description hereinafter. In addition, "around the time when film formation is completed" means the time range of from the time when half of the predetermined film thickness of the protective film 108 of the MgO thin film is formed to the time when film formation is completed.

Specifically, partial pressure of the gas around the time when film formation is completed, inside the vapor deposition chamber 21 is detected based on information from the partial pressure detecting means (pressure detector) 29*c* provided in the periphery of the downstream-side protruding portion 21*c* on the substrate carry-out chamber 23-side of the vapor deposition chamber 21, and the partial pressure of the gas within the vapor deposition chamber 21 is controlled to be kept within the above constant range by a control means 100. More specifically, the amounts of gas introduced from the gas introducing means (gas introducing devices) 29*a* and 29*b* and the amount of gas discharged by the evacuating system (evacuating device) 24*b* are controlled by the control means 100, so that the partial pressure of the gas within the vapor deposition chamber 21 around the time when film formation is completed is controlled to fall within the above constant range. The control means 100 controls the respective processing operations in the substrate carry-in chamber 22, the vapor deposition chamber 21, and the substrate carry-out chamber 23. Specifically, the control means 100 controls the operations of the respective devices and members such as the evacuating system (evacuating devices) 24*a*, 24*b*, and 24*c*, the conveying means (conveying device) 25, the partitions (blocking walls) 26*a*, 26*b*, 26*c* and 26*d*, the substrate heating means (substrate heating devices) 27*a* and 27*b*, the vapor deposition source 28*a*, the electron gun 28*c*, the upstream-side shutter 28*g*, the downstream-side shutter 28*h*, the gas introducing means (gas introducing devices) 29*a* and 29*b*, and the partial pressure detecting means (partial pressure detector) 29*c*.

According to the above described method, vapor deposition is carried out by controlling the atmosphere in such a state that a partial pressure of the gas in the atmosphere around the time when film formation is completed in the vapor deposition chamber 21, which becomes a film forming chamber, $O_2$ gas or a gas including $H_2O$, for example, is kept within the constant range, and thus, the protective film 108 of MgO thin film is formed. According to such a manner, the protective film 108 where the amount of uncombined bonds within the MgO thin film, particularly in the surface layer portion, is controlled can be stably formed. Here, it is desirable for the location in which the partial pressure detecting means (pressure detector) 29*c* is placed to be on the downstream-side protruding portion 21*c*-side of the downstream-side edge 281*h* of the downstream-side shutter 28*h* in such a state that the MgO thin film can be formed. As a result, the partial pressure of the introduced gas can be controlled to be surely kept within the constant range more surely.

In contrast, in conventional film forming apparatuses, a gas introducing means and a partial pressure detecting means are provided on a substrate carry-in chamber side. In the case where a film is formed by controlling the atmosphere within a vapor deposition chamber in such a film forming apparatus, it is practically difficult to provide a uniform atmosphere throughout the entirety of the vapor deposition chamber in the sheet feeding type film forming apparatus. That is to say, there is a difference in the atmosphere of the vapor deposition chamber between the center portion of the vapor deposition chamber which is located above the hearth where there is the vapor deposition source and the substrate carry-in chamber-side and substrate carry-out chamber-side end portions of the vapor deposition chamber in close proximity to the side of the substrate carry-in chamber or the side of the substrate carry-out chamber. In particular, around the time when film formation is completed, the substrate has moved close to the substrate carry-out chamber on the substrate carry-out chamber side of the vapor deposition chamber, and the film properties, which affect the properties of the protective film, greatly change, due to the difference in the state of the gas atmosphere within the vapor deposition chamber.

As described above, in the embodiment of the present invention, $O_2$ gas is used as the gas introduced into the vapor deposition chamber 21 to prevent oxygen deficiency and control the number of dangling bonds, and in addition, a gas including $H_2O$ is used to positively mix impurities, such as H atoms or OH molecules, into the film so as to increase the number of dangling bonds. It is conventionally known that the properties of the MgO thin film, which is a protective film, change due to oxygen deficiency or mixing in of impurities during the film formation process.

The present inventors confirmed that, during the film formation process, change in the properties of the MgO thin film due to oxygen deficiency or mixing in of impurities, particularly around the time when film formation is completed, affects the secondary electron emitting performance, that is, the properties of the protective film during the process of experimentation for examining various properties. In particular, there is oxygen deficiency, or impurities, such as OH molecules originating from $H_2O$, of which a microscopic amount is contained in the raw material of MgO or the atmosphere gas, mix into the surface layer of the MgO thin film which is formed around the time when film formation is completed. Therefore, the bond between Mg atoms and O atoms is disturbed in the MgO thin film, particularly in the surface layer. It is considered that the presence of dangling bonds created as a result, which do not relate to bonding, affects the energy band of MgO in such a manner that the state of emitting of secondary electrons from the protective film greatly changes. Accordingly, in the embodiment of the present invention, a gas including $O_2$ and $H_2O$ is introduced into the vapor deposition chamber 21, which becomes the film forming chamber at the time of film formation, and then, a film is formed by controlling this atmosphere. As a result, the number of dangling bonds inside the MgO thin film, in particular in the surface layer portion, can be controlled.

Next, the step for forming the protective film 108 is concretely described. First, as shown in FIG. 2, in the vapor deposition chamber 21, which becomes the film forming chamber, the front glass substrate 103 is heated to a predetermined temperature by means of the substrate heating means 27*b* using an infrared ray lamp or the like, and then is kept at the predetermined temperature. The temperature for heating is set in a temperature range of approximately 100° C. to 400° C. so that the display electrode 106 and the dielectric layer 107, which are formed on the front glass substrate 103 in advance, do not thermally deteriorate. Then, the vapor deposition source 28*a* is irradiated with the electron beam 28*d* from the electron gun 28*c* to heat in advance (preheat) the vapor deposition source 28*a* (MgO particles) in a state where the lower side of the substrate holding jig 30 is closed, after the upstream-side shutter 28*g* and the downstream-side shutter 28*h* move to the center portion of the vapor deposition chamber 21, and thus, the impurity gas included in the vapor deposition source 28*a* is degassed. At the same time, the impurity gas in the vapor deposition chamber is discharged by means of the evacuating system (evacuating device) 24*b*, and after that, gases are introduced into the vapor deposition chamber 21 through the gas introducing means (gas introducing devices) 29*a* and 29*b*. As the introduced gas, as described above, $O_2$ or a gas including $O_2$ is used to prevent oxygen deficiency in the MgO thin film, and a gas including $H_2O$ is used to positively mix in the impurities, such as H or OH, into the film. Thus, the partial pressure of the gas is controlled so as to be in the constant range in the field of the vapor deposition chamber 21 where a film is formed, from a time when the film with a half of the predetermined film thickness is formed to a time when the film formation is completed.

Figure 3:
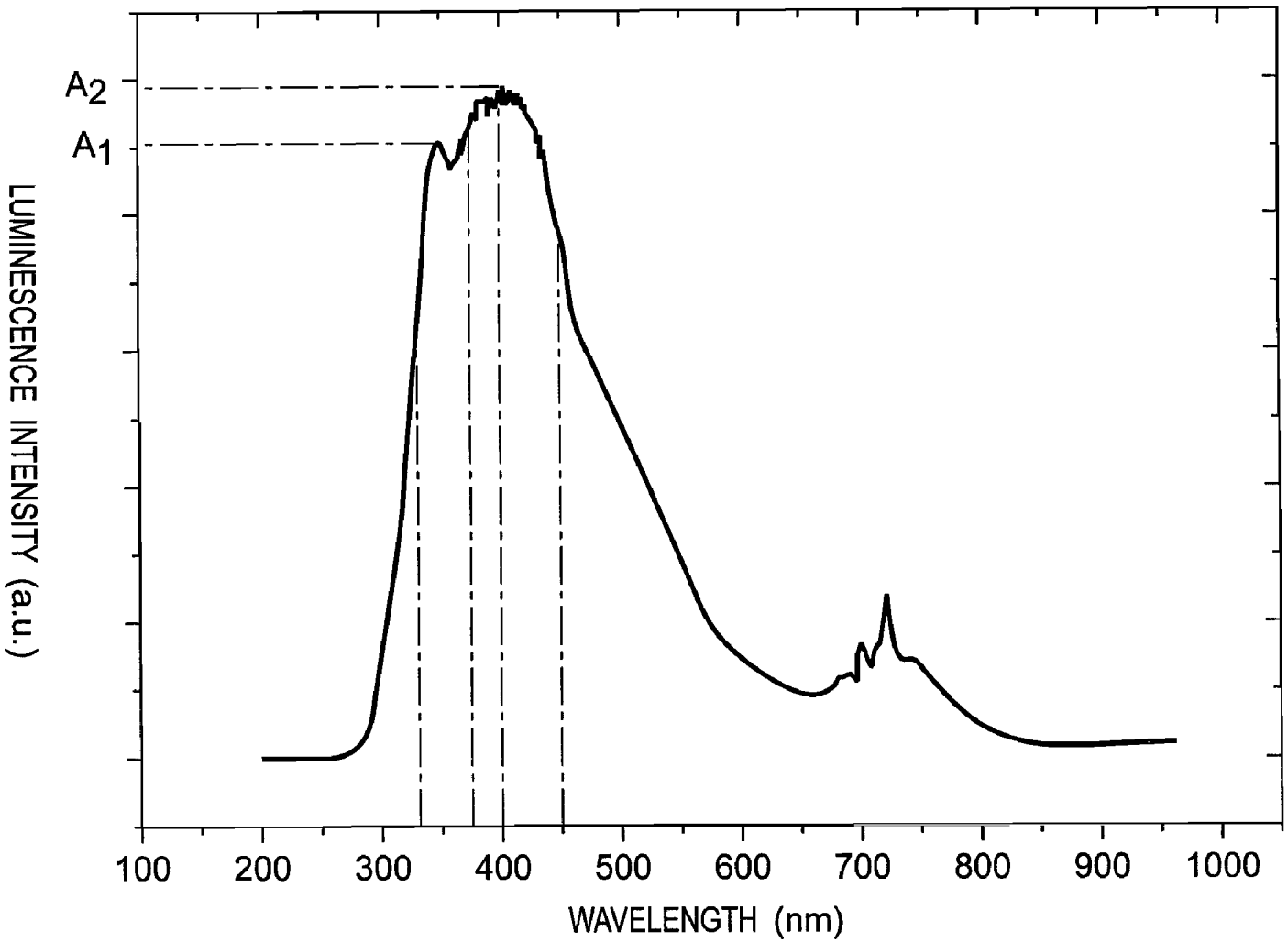
FIG. 3 is a graph showing a luminescence spectrum of the cathode luminescence of an MgO thin film in the PDP according to the embodiment.

FIG. 3 is a view showing the luminescence spectrum of the cathode luminescence of the MgO thin film. The luminescence spectrum shown in FIG. 3 has peaks of maximum luminescence intensity $A_1$ within a luminescence region of 330 nm to 370 nm and maximum luminescence intensity $A_2$ between a wavelength of 400 nm and 450 nm. The ratio $A_2/A_1$ of the maximum luminescence intensity $A_2$ to the maximum luminescence intensity $A_1$ is found from FIG. 3.

Figure 4:
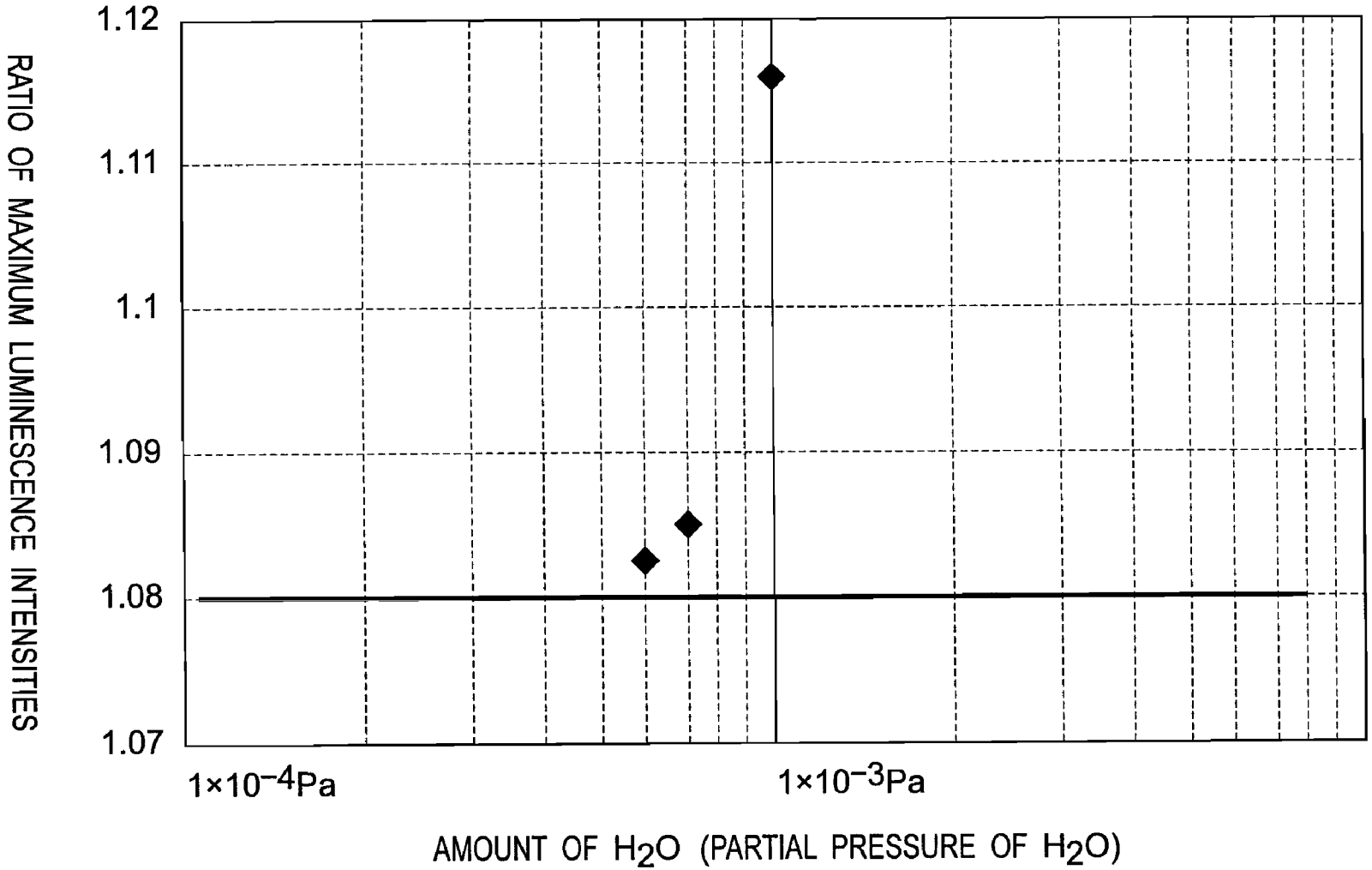
FIG. 4 is a graph showing the ratio $A_2/A_1$ of the maximum light intensity $A_1$ to the maximum light intensity $A_2$ in the cathode luminescence for the partial pressure of $H_2O$ detected using a partial pressure detection means in the PDP according to the embodiment.

FIG. 4 is a view showing the ratio $A_2/A_1$ of the maximum luminescence intensity $A_2$ to the maximum luminescence intensity $A_1$ in the cathode luminescence relative to the partial pressure of $H_2O$ detected by the partial pressure detecting means (pressure detector) 29*c*. It can be seen from FIG. 4 that the maximum luminescence intensity ratio $A_2/A_1$ changes in accordance with the partial pressure of $H_2O$. This is considered to be because when a gas including $H_2O$ is introduced, bonds of OH groups are created in the crystal structure of MgO, resulting in a difference in the oxygen deficiency amount, and thus, the ratio of the maximum luminescence intensity $A_2$ to the maximum luminescence intensity $A_1$ in the light emission of cathode luminescence greatly changes.

In the embodiment of the present invention, the product of the film thickness of the MgO thin film within the surface of the front glass substrate 103 and the ratio of the maximum luminescence intensity $A_2$ to the maximum luminescence intensity $A_1$ in the light emission of the cathode luminescence is controlled so as to be in the predetermined range within the surface. That is to say, the distribution in the film thickness within the surface of the front glass substrate 103 is controlled by adjusting the location and number of vapor deposition sources 28*a* provided in advance. Furthermore, the amount of $H_2O$ introduced through the gas introducing means (gas introducing devices) 29*a* and 29*b* is controlled using the graph in FIG. 4 by the control means 100 so that the partial pressure detected by the partial pressure detecting means (pressure detector) 29*c* has a predetermined value, and thus, the ratio $A_2/A_1$ of the maximum luminescence intensities becomes a predetermined value.

Specifically, a gas including $H_2O$ is introduced into the vapor deposition chamber 21 through the gas introducing means (gas introducing devices) 29*b* and 29*c* while gas is being discharged by the evacuating system (evacuating device) 24*b* in such a manner that the amount of discharged gas and the amount of introduced gas are controlled and adjusted by the control means 100 so that the discharge of gas and the introduction of gas equilibrate. Then, the upstream-side shutter 28*g* and the downstream-side shutter 28*h* are moved toward the side of the substrate carry-in chamber 22 and the side of the substrate carry-out chamber 23, respectively, and then, the state where the lower side of the substrate holding jig 30 is open is maintained, so that the steam flow 28*e* of MgO is jetted against the exposed portion of the front glass substrate 103 exposed through the opening 30*a* thereof. As a result, the ratio of the maximum luminescence intensity changes within the substrate surface, and the product of the film thickness at any arbitrary point in the protective film 108 and the ratio of the maximum luminescence intensities can be controlled so as to fall within a predetermined range in the distribution within the substrate surface.

Next, a more specific process for forming the protective film for the PDP according to the embodiment of the present invention is described. The process is carried out under the following set conditions in the film forming apparatus shown in FIG. 2.

The display electrodes 106 and the dielectric layer 107 are formed on the front glass substrate 103 of predetermined materials under predetermined conditions, where the temperature of the substrate at the time of vapor deposition is set to a temperature of 300° C., at which the formed display electrodes 106 and dielectric layer 107 do not thermally deteriorate. In addition, the ultimate pressure in the vapor deposition chamber 21 is set to $2\times10^{-4}$ Pa or lower, and the electron gun emission current is set to 480 mA at the time of vapor deposition.

The front glass substrate 103 is moved at a constant speed inside the vapor deposition chamber 21 by the conveying means (conveying device) 25, where the substrate convey speed of the conveying means (conveying device) 25 is the constant speed of 800 mm/min, and it is set so that the substrate is carried into the substrate carry-out chamber 23 through the partition 26*c* after the film thickness of the protective film 108 reaches the predetermined value of approximately 900 nm. The pressure within the vapor deposition chamber 21 at the time of vapor deposition is equilibrated to approximately $2\times10^{-2}$ Pa by controlling the amount of introduced $O_2$ gas introduced through the gas introducing means (gas introducing device) 29*a* and the amount of discharged gas discharged through the evacuating system (evacuating device) 24*b* by the control means 100 so that they equilibrate. In addition, the amount of $H_2O$ introduced through the gas introducing means (gas introducing device) 29*b* and the amount of gas discharged through the evacuating system (evacuating device) 24*b* are controlled so that the partial pressure of $H_2O$ gas in the vapor deposition chamber 21 is in a range of from $6\times10^{-4}$ Pa to $2\times10^{-3}$ Pa. In this case, approximately 120 sccm of $O_2$ gas is introduced into the vapor deposition chamber 21 having a volume of approximately 5 $m^3$ through the gas introducing means (gas introducing device) 29*a*, and the pressure at the time of vapor deposition equilibrates at approximately $2\times10^{-2}$ Pa in close proximity to the evacuating system (evacuating device) 24*b*. Then, 10 sccm to 30 sccm of $H_2O$ is introduced through the gas introducing means (gas introducing device) 29*b*.

For the protective film 108, which is the MgO thin film formed in such a manner, the film thickness is measured at a plurality of points, and the cathode luminescence is analyzed. As a result, it is found that the MgO thin film has a value of the average film thickness of the MgO thin film within the surface being 900 nm and a distribution within the surface in terms of variation in the film thickness falling within a range of ±8%. In addition, the ratio $A_2/A_1$ of the maximum luminescence intensities of light emission of cathode luminescence at respective points is 1.08 or higher. In particular, the ratio $A_2/A_1$ in the protective film 108 into which a gas including $H_2O$ is introduced as described above becomes 1.08 or higher. Accordingly, the ratio of the maximum luminescence intensities may be changed as shown in FIG. 4, by controlling the amount of introduced gas including $H_2O$. In the embodiment of the present invention, the product of the film thickness and the ratio of the maximum luminescence intensities is controlled so as to be ±15% or less of the average value of the above described plurality of points within the surface of the substrate. Here, though the average film thickness within the surface of the substrate is 900 nm and the variation in the film thickness is ±8% in the above description, the value of the average film thickness of the MgO thin film within the surface of the substrate may be between 700 nm and 900 nm, and the distribution in the film thickness within the surface may be ±10% or lower.

FIG. 5 is a graph showing the relationship between the product of the film thickness of the protective film 108 and the ratio of the maximum luminescence intensities, and the standardized discharge delay time of the PDP. It can be seen from FIG. 5 that there is a correlation between the product of the film thickness and the ratio of the maximum luminescence intensities, and the discharge delay time of the PDP. That is to say, the distribution in the film thickness is controlled within the surface of the substrate according to the above described method, and the ratio of the maximum luminescence intensities is controlled by adjusting the amount of introduced gas including $H_2O$ downstream in the direction in which the substrate is conveyed, and thus, the product of the film thickness and the ratio of the maximum luminescence intensities is controlled, and as a result, the distribution in the protective film 108 within the surface of the substrate can be controlled.

As shown in FIG. 5, according to the embodiment of the present invention, the product of the film thickness and the ratio of the maximum luminescence intensities is controlled so as to be within a range of ±15% of the average value within the surface of the substrate, and thus, the protective film 108 can be provided where the distribution in the discharge delay time is restricted to ±25% or less. In high definition PDPs, in terms of the resolution of the display, sufficient discharge properties can be gained even in the case where the discharge delay time within the surface of the substrate has a distribution which changes by approximately ±50%. In full high definition PDPs with higher resolution having double the number of pixels and the area per cell is ½ or less, however, the time for address discharge per cell becomes approximately ½, and the capacitance becomes ½. Therefore, it is required for the distribution within the surface required as the discharge delay time to be smaller. As shown in FIG. 5, when the product of the film thickness and the ratio of the maximum luminescence intensities is controlled so as to be within a range of ±15% of the average value within the surface of the substrate and the discharge delay time is controlled to ±25% or less at a plurality of points within the surface of the substrate, the image display quality of the full high definition PDP having high resolution and high image quality can be increased.

By properly combining the arbitrary embodiments of the aforementioned various embodiments, the effects possessed by the embodiments can be produced.

As described above, the PDP according to the present invention is useful for large screen display apparatuses, such as high resolution, high image quality PDPs, particularly for full high definition systems.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A plasma display panel comprising a substrate, a dielectric layer, a protective film, and display electrodes formed on the substrate, the dielectric layer, and the protective film, wherein the protective film is a metal oxide film including magnesium oxide, wherein a product of a film thickness of the protective film at any arbitrary point in the protective film and a ratio of a maximum luminescence intensity of light emission having a wavelength between 400 nm and 450 nm to a maximum luminescence intensity of light emission having a wavelength between 330 nm and 370 nm, as measured in accordance with a cathode luminescence method, at the arbitrary point has variation within a range of ±15% as a distribution within a surface of the protective film, and wherein the ratio of the maximum luminescence intensity of light emission having the wavelength between 400 nm and 450 nm to the maximum luminescence intensity of light emission having the wavelength between 330 nm and 370 nm, as measured in accordance with the cathode luminescence method, is 1.08 or higher.

2. The plasma display panel according to claim 1, wherein an average film thickness of the protective film is in a range of from 700 nm to 900 nm and the distribution within the surface is ±10% or lower.

* * * * *